US008070631B2

(12) United States Patent
Nimmons

(10) Patent No.: US 8,070,631 B2
(45) Date of Patent: Dec. 6, 2011

(54) SYSTEM AND METHOD FOR QUICK RELEASE BASE FOR BASEBALL AND SOFTBALL

(75) Inventor: Kenneth W. Nimmons, Litchfield, IL (US)

(73) Assignee: Kranos IP Corporation, Litchfield, IL (US)

( * ) Notice: Subject to any disclaimer, the term of this patent is extended or adjusted under 35 U.S.C. 154(b) by 0 days.

(21) Appl. No.: 11/983,589

(22) Filed: Nov. 9, 2007

(65) Prior Publication Data

US 2009/0124436 A1 May 14, 2009

(51) Int. Cl.
*A63B 71/00* (2006.01)

(52) U.S. Cl. ..... 473/499; 473/501

(58) Field of Classification Search ..... 473/497, 473/499, 500, 501

See application file for complete search history.

(56) References Cited

U.S. PATENT DOCUMENTS

| | | | |
|---|---|---|---|
| 2,275,547 | A | 3/1942 | Mouch |
| 3,181,863 | A | 5/1965 | Nellermoe |
| 3,836,146 | A | 9/1974 | Golomb |
| 3,862,756 | A | 1/1975 | Selliken |
| 4,160,324 | A | 7/1979 | Dunn |
| 4,266,768 | A | 5/1981 | Hall |
| 4,398,715 | A | 8/1983 | Hall |
| 4,529,199 | A | 7/1985 | Fatool |
| 4,531,733 | A | 7/1985 | Hall |
| 4,542,901 | A | 9/1985 | Fatool et al. |
| 4,634,120 | A | 1/1987 | Hall |
| 4,744,561 | A | 5/1988 | Hall |
| 4,976,430 | A | 12/1990 | Brandon |
| 4,979,740 | A | 12/1990 | Hall |
| 5,000,447 | A | 3/1991 | Bartoli |
| 5,415,394 | A | 5/1995 | Hall |
| 5,415,395 | A | 5/1995 | Bartoli |
| 5,556,089 | A | 9/1996 | Hall |
| 5,564,695 | A | 10/1996 | Christensen |
| 5,590,874 | A | 1/1997 | Hall |
| 5,601,900 | A | 2/1997 | Doscher |

(Continued)

FOREIGN PATENT DOCUMENTS

CA 1 250 330 A 2/1989

(Continued)

OTHER PUBLICATIONS

"Rogers Break Away Base System," published by Rogers Sports Corporation, published 1993, two pages.

(Continued)

*Primary Examiner* — Mitra Aryanpour

(74) *Attorney, Agent, or Firm* — Notaro, Michalos & Zaccaria P.C.

(57) ABSTRACT

A quick release base system that includes a base platform and a removable base. The base platform includes a bottom platform surface and a top platform surface. The top platform surface is positioned above the bottom platform surface. The top platform surface includes platform prongs. The platform prongs are substantially perpendicular to the top platform surface and extend away from the top platform surface and away from the bottom platform surface. The removable base rests on top of the base platform, and the removable base includes an interior base surface. The interior base surface includes base prongs. The base prongs are substantially perpendicular to the interior base surface and extend away from the interior base, and the platform prongs interact with the base prongs to create a lateral restraining force between the base platform and the removable base.

8 Claims, 4 Drawing Sheets

U.S. PATENT DOCUMENTS

| | | | | |
|---|---|---|---|---|
| 5,772,539 | A | 6/1998 | Hall | |
| 6,077,175 | A | 6/2000 | Fearnow | |
| D477,171 | S | 7/2003 | Gabbour | |
| 7,717,813 | B2 * | 5/2010 | Sinovich | 473/499 |
| 2007/0123375 | A1 | 5/2007 | Mescher | |
| 2008/0108460 | A1 | 5/2008 | Sinovich | |
| 2008/0171621 | A1 | 7/2008 | Jacobson | |
| 2008/0194361 | A1 | 8/2008 | Hadar | |
| 2010/0279802 | A1 * | 11/2010 | Sinovich | 473/499 |

FOREIGN PATENT DOCUMENTS

| | | | |
|---|---|---|---|
| CA | 2034748 | A1 | 9/1991 |
| CA | 2092611 | A1 | 9/1994 |

OTHER PUBLICATIONS

"Clinical Study Information—Comparing Conventional Bases with the Rogers Break Away Base System," published by Rogers Sports Corporation, published Sep. 1993, pp. 1-16.

"Dive Into Spring," published by Softball Sales, published in Spring of 2007, p. 53.

"Installation Instructions for Soft Touch in ground Mount Bases," published by Soft Touch Bases, published prior to Nov. 9, 2007, two pages.

"Their Dreams Are Safe . . . " published by Rogers Sports Corporation, published prior to Nov. 9, 2007, four pages.

Author unknown. "Baseball Breakaway Base Set," publicly available at http://baseball.epicsports.com/prod/15862/baseball-breakaway-base-set.html?trk=1326780 as of Apr. 22, 2010, two pages.

Author unknown. "Champion Sports Breakaway Baseball Base," publicly available at http://www.dazadi.com/Sporting-Goods/Baseball/Field-Equipment/Bases-&-Home-Plates/Bases/Champion-Sports-Breakaway-Baseball-Base-.html?utm source=googlebase &utm medium=shopping&utm campaign=&CID=googlebase as of Apr. 22, 2010, two pages.

Author unknown. "Rogers Baseball Base and Softball Base—Accept No Substitutes," publicly available at http://www.rogersbreakawaybase.com/index.html as of Apr. 22, 2010, one page.

* cited by examiner

Fig. 1A
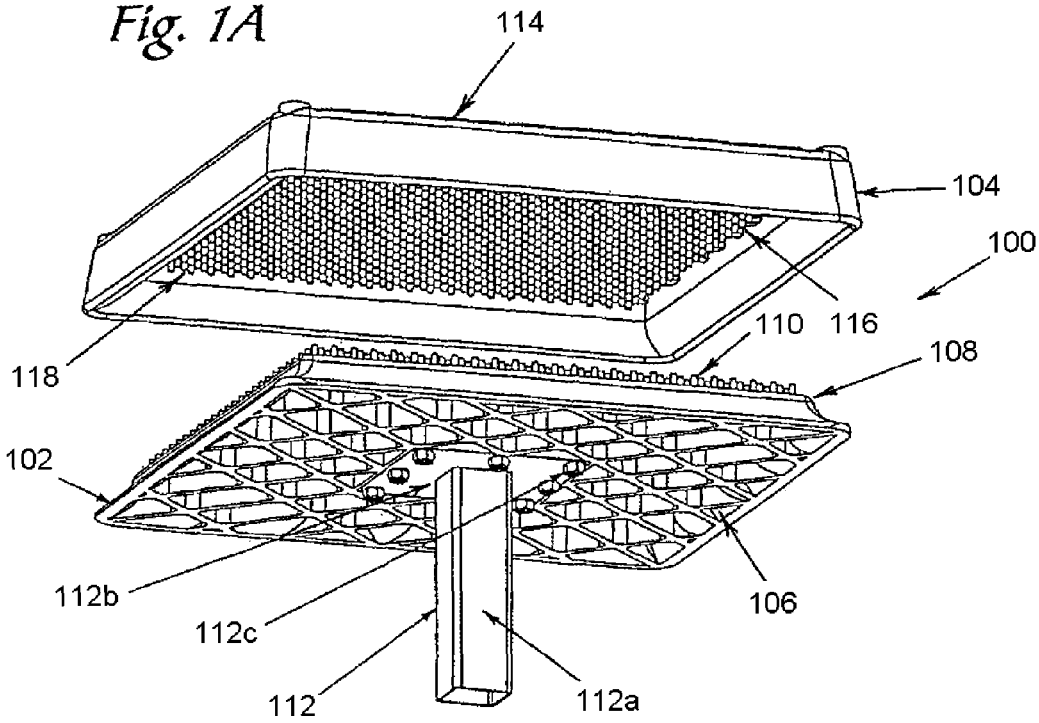
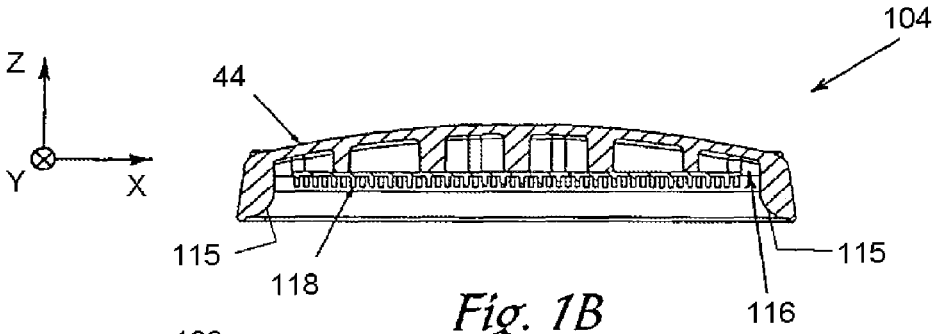
Fig. 1B
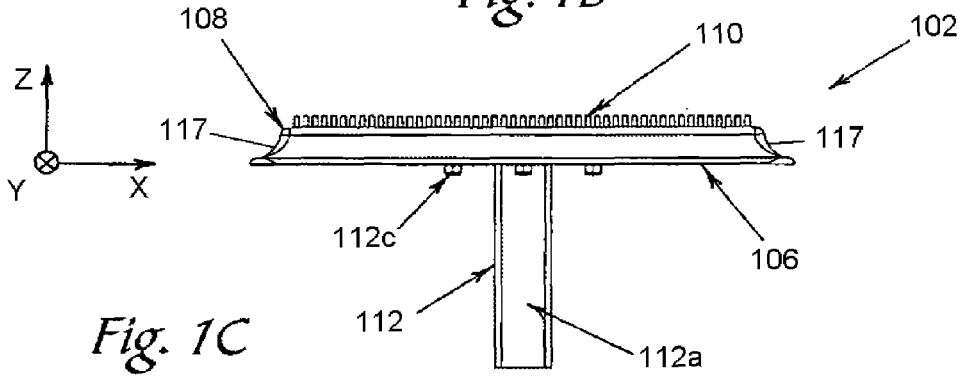
Fig. 1C

SYSTEM AND METHOD FOR QUICK RELEASE BASE FOR BASEBALL AND SOFTBALL

BACKGROUND OF THE INVENTION

1. Field of the Invention

The invention generally relates to equipment in baseball and softball. More specifically, the invention relates to bases that are used in the games of baseball and softball.

2. Discussion of Related Art

In the United States and Canada and in many East Asian, Latin American and Caribbean countries, the games of softball and baseball are very popular.

Familiarity with the basic concepts of the rules of baseball and softball are assumed, as one of ordinary skill in the art would know the rules intimately. However, the rules of baseball and softball provide for markers known as bases that are positioned at the four corners of a diamond, up to 90 feet in distance depending upon the age level of the players or whether baseball of softball is being played. Three of the bases are commonly referred to as bags, because they are short boxes that are placed on the surface of the ground and rise up one to three inches in height. The fourth base, known as home plate, is much thinner and rises above the ground less than ½ inch.

These bases are commonly held in position in a number of ways. For example, major league teams and other organized baseball leagues generally use hollow, square metal posts or anchors located in the ground at the proper base locations. Stanchions that are attached to the bottom of the bases are placed in the hollow posts/anchors. In this manner, the bases are firmly and fixedly, yet removably positioned for play. Runners naming to the bases do not have to fear that the bases will slide as the runner slides into or steps on the base. This method requires digging a hole into the ground, placing a concrete bed in the hole, setting the anchor/post in the concrete bed and repacking the dirt around the post/anchor. This can be accomplished on a dedicated baseball field.

A second common type of base uses spikes that are driven into the ground that are attached to straps. The straps are cinched tight to the base and the spikes that hold the base in position.

A third common category of common bases is called "throwdown bases." These bases typically are formed from a single piece or molded rubber or vinyl. These bases are generally thinner than, official bases.

Another type of base uses a magnet to secure a base having a bottom metal material. Dislodgement of the base exposes the magnet which can be poorly seen due to dirt and dust accumulating on it.

Other types of bases use either an oversized hole to receive an anchor for the base or can use protruding rubber tips which are inserted in openings formed in a substrate and trapped therein until a sufficient force is applied to the base. Such rubber tips are not able to be freely removed from the substrate.

Moreover, youth baseball leagues have recently mandated that a base is displaced from its position when a runner slides into it. Put another way, leagues are requiring a base that will move when a lateral load is applied. The difficulty is designing such a base that will not substantially move when the runner merely runs across the base, i.e. when the load applied is a combination of a lateral load and a vertical load.

Therefore, there is a need in the art for detachable/removable baseball and softball bases that will not substantially move when a runner runs across it and yet will detach when a runner slides in with sufficient force.

SUMMARY OF THE INVENTION

In general, in one aspect, the present invention features a quick release base system that includes a base platform and a removable base. The base platform includes a bottom platform surface and a top platform surface. The top platform surface is positioned above the bottom platform surface. The top platform surface includes platform prongs. The platform prongs are substantially perpendicular to the top platform surface and extend away from the top platform surface and away from the bottom platform surface. The removable base rests on top of the base platform, and the removable base includes an interior base surface. The interior base surface includes base prongs. The base prongs are substantially perpendicular to the interior base surface and extend away from the interior base, and the platform prongs interact with the base prongs to create a lateral restraining force between the base platform and the removable base.

In general, in another aspect, the present invention features a removable base. The removable base includes an interior base surface and an exterior base surface positioned above the interior base surface. The removable base further includes base prongs attached to the interior base surface. The base prongs are uniformly spaced in a grid on the interior surface. The base prongs are substantially perpendicular to the interior surface and extending away from the interior surface.

In general, in another aspect, the present invention features a base platform. The base platform includes a bottom platform surface and a top platform surface that is positioned above the bottom platform surface. The base platform further includes platform prongs that are attached to the top platform surface. The platform prongs are uniformly spaced in a grid on the top platform surface. The platform prongs are substantially perpendicular to the upper platform surface and extend away from the upper platform surface and away from the bottom platform surface.

In general, in another aspect, the present invention features a method for using a base system. The method includes providing a base platform. The base platform includes a bottom platform surface and a top platform surface. The top platform surface is positioned above the bottom platform surface. The top platform surface includes platform prongs. The platform prongs are substantially perpendicular to the top platform surface and extend away from the top platform surface and away from the bottom platform surface. The method further includes providing a removable base. The removable base rests on top of the base platform, and the removable base includes an interior base surface. The interior base surface includes base prongs. The base prongs are substantially perpendicular to the interior base surface and extend away from the interior base, and the platform prongs interact with the base prongs to create a lateral restraining force between the base platform and the removable base. The method further includes subjecting the removable base to a high-impact potential external lateral force such that the removable base detaches from the base platform as a result of the high-impact potential external lateral force.

Details of particular embodiments of the present invention are set forth in the accompanying drawings and in the description below. Further features, aspects, and advantages of the present invention will become apparent from the description, the drawings, and the claims.

BRIEF DESCRIPTION OF THE DRAWINGS

FIG. 1A is bottom perspective view of an embodiment of a quick release base system according to the present invention;

FIG. 1B is a side cross-sectional view of an embodiment of a removable base to be used with the quick release base system of FIG. 1A according to the present invention;

FIG. 1C is a side view of an embodiment of a base platform to be used with the quick release base system of FIG. 1A according to the present invention;

DETAILED DESCRIPTION

Figure 2A:
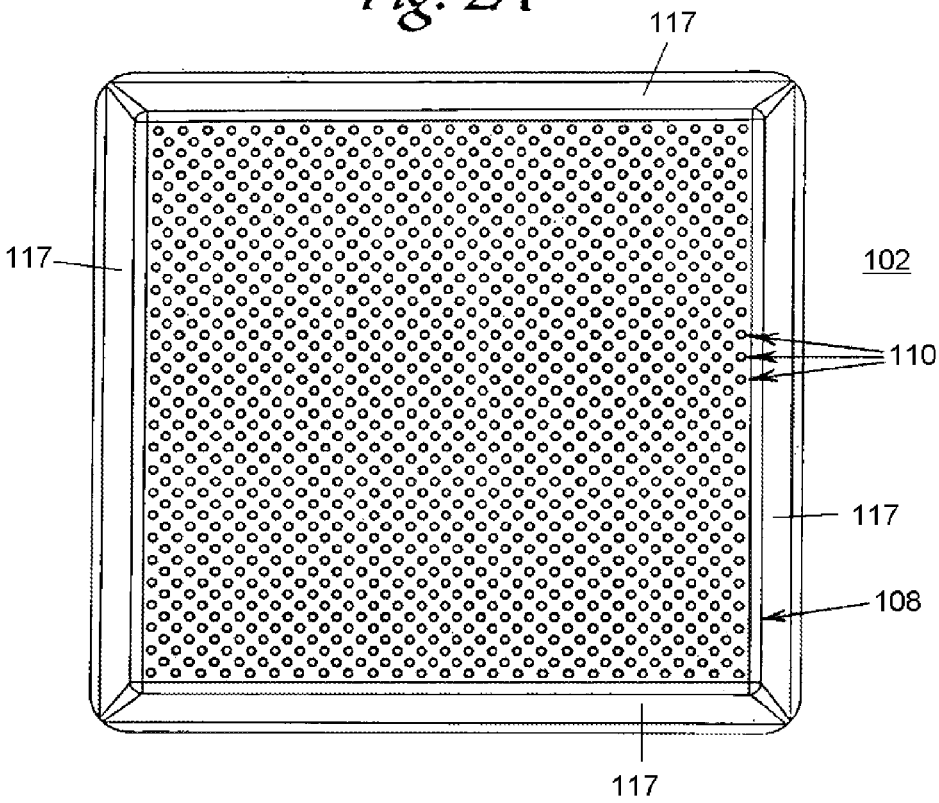
FIG. 2A is a top view of the base platform of FIG. 1C.

Details of particular embodiments of the invention are set forth in the description below and in the accompanying drawings. Like reference numbers and designations in the various drawings indicate like elements.

Referring to FIGS. 1A-1C and 2A-B, one embodiment of a quick release base system 100 according to the present invention includes a base platform 102 and a removable base 104. The base platform 102 and removable base 104 are made of a deformable material that has a Durometer reading ranging from 65 to 75 Shore D. The base system 100 is configured such that the removable base 104 rests on top of the base platform 102. However, the removable base 104 is not secured to the base platform 102, e.g., by straps, woven hook and loop members, and so on, and the upward vertical movement (direction along z-direction) of the removable base 104 is substantially unrestrained by the base platform 102. Accordingly, the removable base 104 can be pulled up from the base system 100 relatively easily.

As described in more detail below, the base platform 102 interacts with the removable base 104 to create a lateral (direction parallel to x-y plane) restraining force between the base platform 102 and the removable base 104. The resulting lateral restraining force restrains the lateral movement of the removable base 104 relative to the base platform 102. Accordingly, the removable base 104 does not detach from the base platform 102 when a relatively small external lateral force (e.g., a low-impact potential lateral force) is applied to the removable base 104. The removable base 104 can detach from the base platform 102 when a relatively large external lateral force (e.g., a high-impact potential lateral force) is applied to the removable base 104 so as to make the prongs 110 and 118 of the removable base 104 and base platform 102 to bend sufficiently to allow detachment. An example of a low-impact potential external lateral force is a player running or walking over the base 104 at a relatively low speed. An example of a high-impact potential external lateral force is a base runner sliding into the base 104 at a relatively high speed.

For example, when an embodiment of the removable base 104 designed for youth play is subjected to a static force that is 25 lbs or more and directed at a 30° angle (lateral force 21.7 pounds or greater) with respect to the playing field, the removable base detaches from the base platform 102. The same removable base 104 detaches from the base platform 102 when a static force that is 10 lbs or more is applied at an angle of 45° (lateral force 7.1 pounds or greater) with respect to the playing field.

When an embodiment of the removable base 104 designed for adult play is subjected to a static force that is 40 lbs or more and directed at a 30° angle (lateral force 24.5 pounds or greater) with respect to the playing field, the removable base detaches from the base platform 102. The same removable base 104 detaches from the base platform 102 when a static force that is 17 lbs or more is applied at an angle of 45° (lateral force 12.0 pounds or greater) with respect to the playing field.

The base platform 102 of the base system 100 includes a bottom platform surface 106 and a top platform surface 108 that is positioned e.g., 1-2 inches, above the bottom platform surface 106. The base platform 102 is made of a sturdy and deformable material, such as rubber, so that it can absorb impacts from a sliding ball player should it be used as a base when the removable base 104 is detached. The top platform surface 108 includes a set of platform prongs 110. In one embodiment, the platform prongs 110 are integrally attached perpendicularly to the top platform surface 108 and extend away from the top platform surface 108. As described below, attributes of the platform prongs 110 such as height, shape and material can vary depending on the desired use of the base system 100 (e.g., depending on whether the base system 100 is used by adults or children).

The base platform 102 of the base system 100 can further include a stanchion 112 attached to the bottom platform surface 106. The stanchion 112 can be substantially perpendicular to the bottom platform surface 106 and extend away from the bottom platform surface 106 (and away from the top platform surface 108). The stanchion 112 can include a stanchion tube 112*a* and a rectangular stanchion plate 112*b*. The stanchion plate 112*b* can be affixed to the bottom platform surface 106, e.g., by nuts 112*c*, screws, glue, and so on. Preferably, eight bolts engaged with eight openings 113 (see FIG. 2B) of the bottom platform surface 106 are inserted through corresponding holes of the stanchion plate 112 and held in place by nuts 112*c* as shown in FIG. 1A. The stanchion tube 112*a* can take a variety of shapes, e.g., a rectangular prism that is configured to fit into a hollow square metal post that is typically dug into the ground at a proper base location at a baseball field.

The removable base 104 that rests on top of the base platform 102 includes an exterior base surface 114 and an interior base surface 116. The exterior base surface 114 can be of any known construction and is preferably of standard size and shape used for baseball and/or softball. A chevron rib structure can be employed to the exterior base surface 114 such as disclosed in U.S. Pat. Nos. 5,000,447 and 5,415,395, the entire contents of each of which are incorporated herein by reference. Such a chevron structure aids in absorbing the impact energy of a sliding player. The interior base surface 116 underlies the chevron structure and includes a set of base prongs 118. In one embodiment, the base prongs 118 are attached perpendicularly to the interior base surface 116 and extend away from the interior base surface 116. As described below, attributes of the base prongs 118 such as height, shape and material can vary depending on the desired use of the base system 100 (e.g., depending on whether the base system 100 is used by adults or children).

The platform prongs 110 and the base prongs 118 can be arranged in a variety of ways as long as, when the removable base 104 rests on top of the base platform 102, the platform prongs 110 interact with the base prongs 118 to create a lateral restraining force between that base platform 102 and the removable base 104. In one embodiment, when the removable base 104 rests on top of the base platform 102, the platform prongs 110 mesh with the base prongs 118, that is, the platform prongs 110 rest in the spaces between the base prongs 118, as illustrated in FIG. 2A. In such a configuration, each base prong 118 is surrounded by several platform prongs 110 and vice versa. As a result, in the presence of an external lateral force on the removable base 104, the platform prongs 110 restrain the lateral movement of the removable base 104 by pushing on the base prongs 118 in the direction opposite to the external lateral force. Furthermore, the only resistance to vertical movement in the z-direction is the frictional interaction between the platform prongs 110 and the base prongs 118. Accordingly, it is relatively easy to remove or engage the removable base 104 with the base platform 102.

Figure 3A:
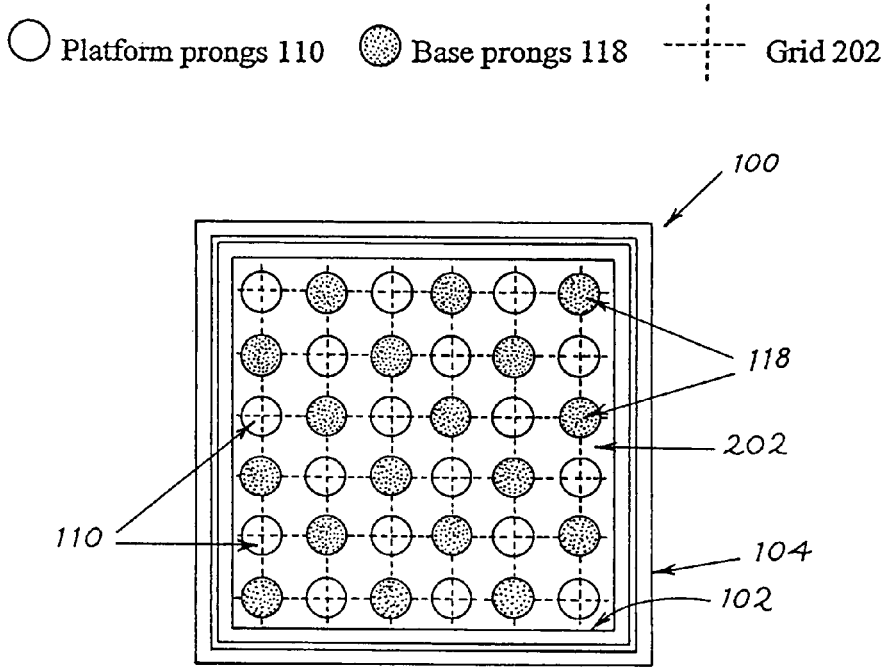
FIG. 3A is a schematic illustrating one possible alignment of prongs of the base platform of FIG. 1C and prongs of the removable base of FIG. 1B on a rectangular grid in accordance with the present invention.
Figure 3B:
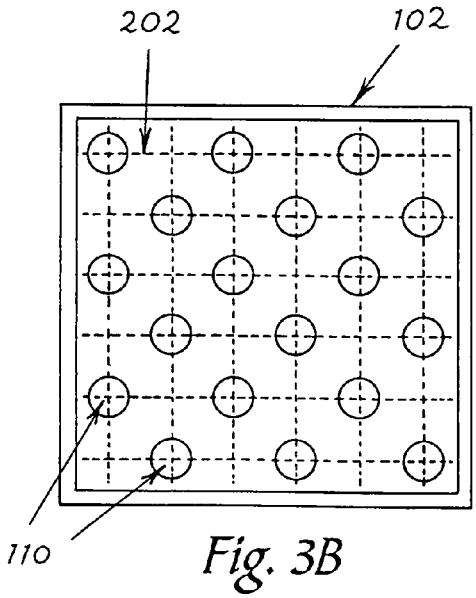
FIG. 3B is a schematic illustrating one possible alignment of prongs of the base platform of FIG. 3A in accordance with the present invention.
Figure 3C:
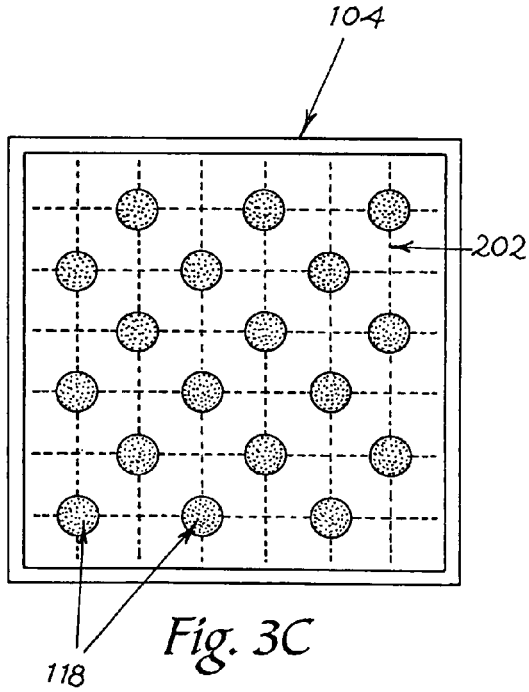
FIG. 3C is a schematic illustrating one possible alignment of prongs of the removable base of FIG. 3A in accordance with the present invention.

Referring to FIGS. 3A-3C, in one embodiment, the platform prongs 110 and the base prongs 118 are arranged along the same, e.g., rectangular, spatial grid 202 and occupy adjacent points on such a grid 202 when the removable base 104 rests on top the base platform 102. Although FIGS. 3A-3C illustrate a rectangular grid, it should be understood that the platform prongs 110 and the base prongs 118 can be arranged in a variety of other ways as long as the platform prongs 110 restrain the lateral movement of the base prongs 118. For example, the patterns in FIGS. 3A-3C can be reversed or rotated. Furthermore, the number of prongs 110, 118 can be reduced or increased by adding or subtracting prongs from the original pattern in a symmetrical manner.

As explained above, the platform prongs 110 interact with the base prongs 118 to create a lateral restraining force between the base platform 102 and the removable base 104, and the resulting lateral restraining force restrains the lateral movement of the removable base 104. Accordingly, the removable base 104 does not detach from the base platform 102 when a low-impact potential lateral force is applied to the removable base 104, but the removable base 104 can detach from the base platform 102 if a high-impact potential lateral force is applied to the removable base 104. It may be desirable to adjust the threshold for the high-impact potential lateral force, depending on the use of the base system 100. For example, the threshold for the high-impact potential lateral force may be relatively high if the base system 100 is used in an adult game. If the base system 100 is used in a youth game, on the other hand, the threshold for the high-impact potential lateral force may be lower.

A number of factors can determine how much lateral force, if applied to the removable base 104, would be sufficient to detach the removable base 104 from the base platform 102. These factors include, for example, density, height, shape, spacing, and material of the platform prongs 118 and the base prongs 118. For example, a relatively small lateral force would be sufficient to detach the removable base 104 from the base platform 102 if the prongs 110, 118 are sparsely spaced, if the prongs 110, 118 are relatively short, or if the prongs 110, 118 are made of relatively soft material, or material that has a low coefficient of friction.

Figure 2B:
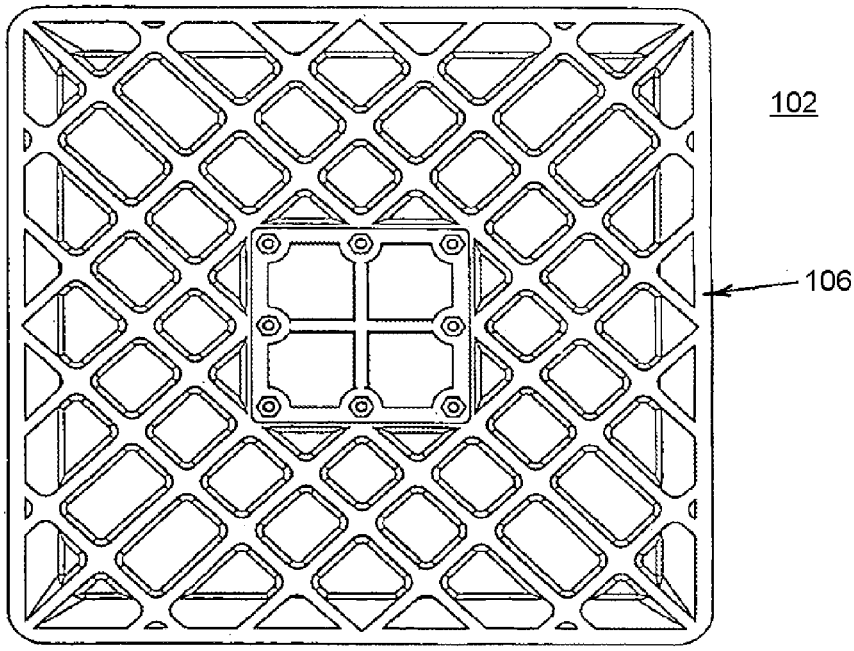
FIG. 2B is a bottom view of the base platform of FIG. 1C.

In embodiment designed for youth play and mentioned previously, the prongs 110, 118 are cylindrical in shape with 0.125 inches in diameter and 0.344 inches in height. The height of the prongs 110, 118 can range from 0.25 inches to 0.50 inches, wherein the longer the prongs are made the greater the lateral force is needed to achieve detachment. The prongs can have other dimensions and cross-sectional shapes, such as polygonal cross-sectional shapes (pentagons or hexagons, for example). The prongs 110, 118 are each arranged on a rectangular grid of 12 inches by 12 inches with uniformly spaced horizontal and vertical lines, wherein prongs in each line are separated from one another by a constant distance d equal to approximately 0.5 inches. In addition, prongs of one line are offset from prongs of an adjacent line by an amount equal to one half the separation d as shown in FIGS. 2*b* and 2*c*. This results in a density of approximately 13 prongs 110, 118 per square inch. Both the horizontal lines and the vertical lines are spaced approximately 0.25 inches apart from each other. The resulting density of prongs 110, 118 intermeshing with one another when the removable base 104 rests on top the base platform 102 as shown in FIG. 3A is approximately 25 platform prongs 110, 118 per square inch. That is, the distance between the center of a given platform prong 110 and the center of the nearest base prong 118 is approximately 0.25 inches. The platform prongs 110 and the base prongs 118 are made of a deformable material, e.g., rubber, and they are attached to the base platform 102 and the removable base 104 respectively by glue.

Figure 4:
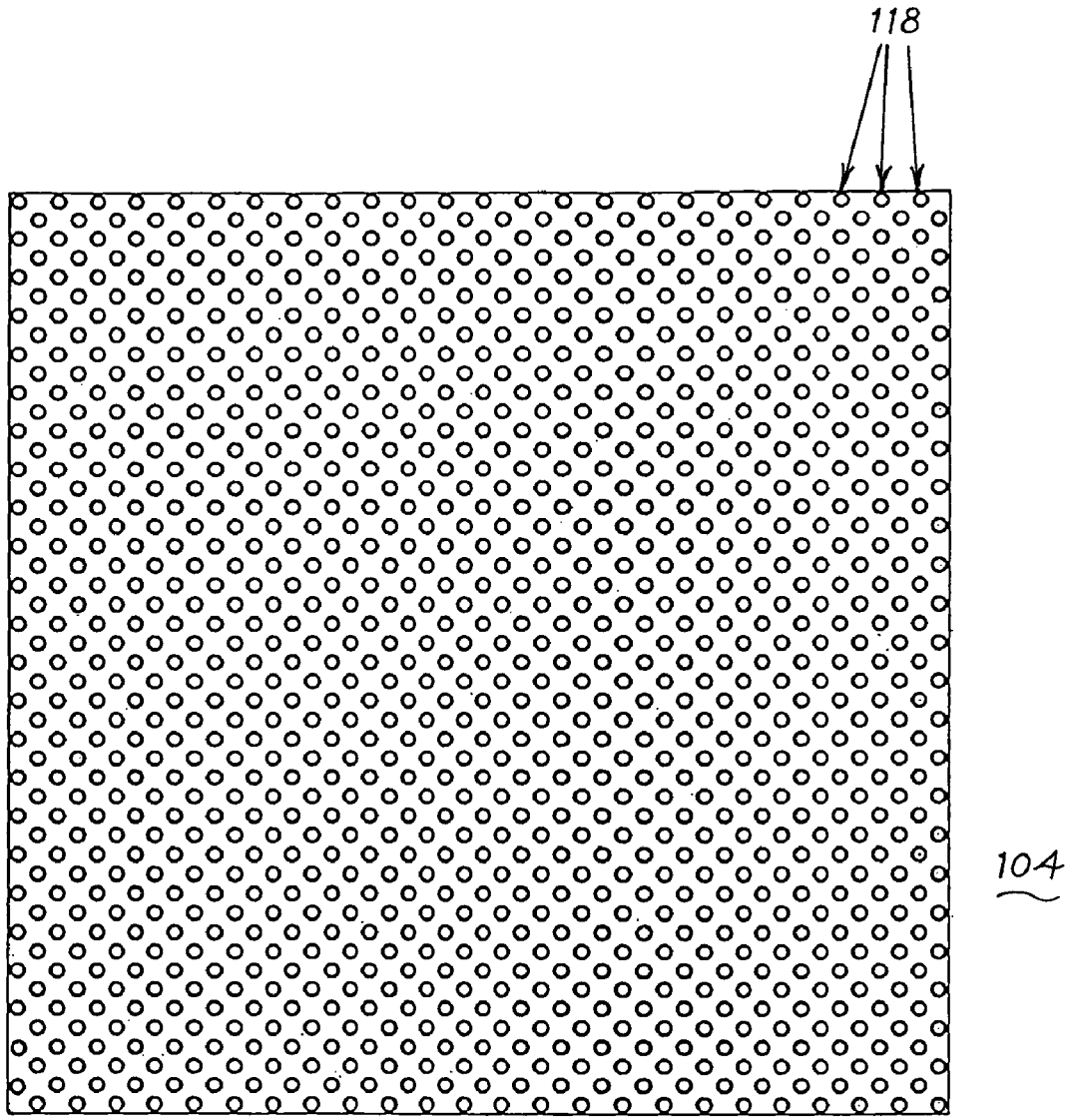
FIG. 4 shows one possible alignment of prongs for the removable base of FIG. 1B to be used with the base platform of FIGS. 1C, 2A-B and 3.

In another embodiment designed for adult play and mentioned previously, the prongs 110 of the base platform 108 are sized/shaped positioned/arranged in the same manner as described previously with respect to the youth play embodiment. In this embodiment, the prongs 118 of the removable base 104 are the same size and shape as in the youth play embodiment. The prongs 118 are arranged on a rectangular grid of 12 inches by 12 inches with uniformly spaced horizontal and vertical lines, wherein prongs in each line are separated from one another by a constant distance d equal to approximately 0.25 inches. In addition, prongs of one line are not offset from prongs of an adjacent line as shown in FIG. 4. This results in a density of approximately 25 prongs 118 per square inch. Since the density of prongs increases, the lateral force to cause detachment increases due to increased friction and larger bending forces required for detachment. Both the horizontal lines and the vertical lines of the prongs 118 are spaced approximately 0.25 inches apart from each other. The resulting density of prongs 110, 118 intermeshing with one another when the removable base 104 rests on top the base platform 102 as shown in FIG. 2A is approximately 49 platform prongs 110, 118 per square inch. In this embodiment, two consecutive prongs 118 will fit between two consecutive prongs 108 of the base platform which is in contrast with the one prong 118 fitting between consecutive prongs 108 as shown in FIG. 3A.

It should be mentioned that when the removable base 104 rests on the base platform 108 in the manner described previously, a curved, convex inner shoulder 115 of the removable base 104 rests on a complementarily shaped concave outer shoulder 117 of the base platform 108. The shoulders 115, 117 extend along each side of the removable base 104 and base platform 108, respectively. Having the shoulder 115 rest on shoulder 117 aids in retaining the removable base 104 on the base platform 108 as runner rounds the base. In particular, when the runner cuts the corner of the base by stepping on an inner (as viewed from home plate) corner of the removable base 104, the engagement between the shoulders 115, 117 provides additional stability to the base so that the possibility of detachment is reduced. Besides reducing detachment, the shoulders 115, 117 allow for easy and quick placement of the removable base 104 on the base platform 108.

Should the removable base 104 be detached from the base platform 108, the base platform 108 can act as a regular base until play is halted at which time the removable base 104 can be placed back on the base platform 108 in the manner described previously. The base platform 108 is made of a deformable plastic material that will absorb some of the shock of a player sliding into it. The base platform 108 and its prongs 118 are preferably of a distinct color, such as orange, that will make it easy for the players and umpires to locate the platform when it is temporarily acting as a base.

The foregoing description is provided to illustrate the invention, and is not to be construed as a limitation. Numerous additions, substitutions and other changes can be made to the invention without departing from its scope as set forth in the appended claims.

I claim:

1. A removable base comprising:

an interior base surface;

an exterior base surface positioned above the interior base surface;

a curved, convex inner shoulder that is integrally attached to the exterior base surface and defines a wall with a closed perimeter; and a plurality of prongs attached to the interior base surface and uniformly spaced in a grid on the interior surface, the plurality of prongs being substantially perpendicular to the interior surface and extending away from the interior surface along a first direction.

2. The removable base of claim 1, wherein each of the plurality of prongs is substantially cylindrical in shape.

3. The removable base of claim 1, wherein the plurality of prongs are made of deformable material.

4. A quick release base system comprising:

a base platform comprising:

a bottom platform surface;

a top platform surface positioned above the bottom platform surface, the top platform surface including a first plurality of prongs, wherein the first plurality of prongs are substantially perpendicular to the top platform surface of the base platform and extend away from the top platform surface and away from the bottom platform surface;

a removable base that rests on top of the base platform comprising an interior base surface comprising a second plurality of prongs, wherein:

the second plurality of prongs are substantially perpendicular to the interior base surface and extend away from the interior base along a vertical direction when the removable base rests on top of the base platform, and the first plurality of prongs interact with the second plurality of prongs so as to create a lateral restraining force between the base platform and the removable base while at the same time the first plurality of prongs and second plurality of prongs are engaged to one another in a manner so as to allow substantially unencumbered movement of the removable base along the vertical direction;

the base platform comprising a concave outer shoulder integrally attached to the bottom platform surface and the top platform surface; and wherein the removable base comprises a curved, convex inner shoulder that is integrally attached to the exterior base surface, complementarily shaped to the concave outer shoulder and defines a wall with a closed perimeter, wherein the curved, convex inner shoulder rests on the concave outer shoulder.

5. The quick release base system of claim 4, wherein the curved, convex inner shoulder defines a wall with a closed perimeter; and wherein a portion of the wall extends in the vertical direction past free ends of the second plurality of prongs.

6. A base platform comprising:

a bottom platform surface;

a top platform surface positioned above the bottom platform surface;

a plurality of prongs attached to the top platform surface and uniformly spaced in a grid on the top platform surface, the plurality of prongs being substantially perpendicular to the upper platform surface and extending away from the upper platform surface and away from the bottom platform surface along a first direction, wherein each of the plurality of prongs fails to have an appendage that extends along a second direction perpendicular to the first direction; and a concave outer shoulder integrally attached to the bottom platform surface and the top platform surface.

7. A method for using a quick release base system, comprising:

providing a base platform, the base platform comprising:

a bottom platform surface; and a top platform surface positioned above the bottom platform surface, the top platform surface comprising a first plurality of prongs, wherein the first plurality of prongs are substantially perpendicular to the top platform surface of the base platform and extended away from the top platform surface and the bottom platform surface;

providing a removable base on top of the base platform, the removable base comprising:

an interior base surface; and an exterior base surface positioned above the interior base surface, the interior base surface including a second plurality of prongs, wherein the second plurality of prongs are substantially perpendicular to the interior base surface and extended away from the interior base surface along a vertical direction when the removable base rests on top of the base platform, and wherein the first plurality of prongs interact with the second plurality of prongs so as to create a lateral restraining force between the base platform and the removable base while at the same time the first plurality of prongs and second plurality of prongs are engaged to one another in a manner so as to allow substantially unencumbered movement of the removable base along the vertical direction; and subjecting the removable base to a potential external lateral force such that the removable base detaches from the base platform as a result of the potential external lateral force;

the base platform comprising concave outer shoulder integrally attached to the bottom platform surface and the top platform surface; and wherein the removable base comprises a curved, convex inner shoulder that is integrally attached to the exterior base surface, complementarily shaped to the concave outer shoulder and defines a wall with a closed perimeter, wherein the curved, convex inner shoulder rests on the concave outer shoulder.

8. The method of claim 7, wherein the curved, convex inner shoulder defines a wall with a closed perimeter; and wherein a portion of the wall extends in the vertical direction past free ends of the second plurality of prongs.

* * * * *